US010689076B2

(12) United States Patent
Vautier et al.

(10) Patent No.: US 10,689,076 B2
(45) Date of Patent: Jun. 23, 2020

(54) SHIP'S SAIL MADE UP OF ARTICULATED PANELS AND SHIP EQUIPPED THEREWITH

(71) Applicant: CHANTIERS DE L'ATLANTIQUE, Saint Nazaire (FR)

(72) Inventors: Vianney Vautier, Saint Nazaire (FR); Nicolas Abiven, La Baule (FR); Stéphane Cordier, Pornic (FR)

(73) Assignee: CHANTIERS DE L'ATLANTIQUE, Saint Nazaire (FR)

( * ) Notice: Subject to any disclaimer, the term of this patent is extended or adjusted under 35 U.S.C. 154(b) by 0 days.

(21) Appl. No.: 16/463,322

(22) PCT Filed: Nov. 20, 2017

(86) PCT No.: PCT/EP2017/079764

§ 371 (c)(1),
(2) Date: May 22, 2019

(87) PCT Pub. No.: WO2018/095860

PCT Pub. Date: May 31, 2018

(65) Prior Publication Data

US 2019/0270498 A1 Sep. 5, 2019

(30) Foreign Application Priority Data

Nov. 25, 2016 (FR) ..... 16 61489

(51) Int. Cl.

| | |
|---|---|
| ***B63H 9/061*** | (2020.01) |
| ***B63H 9/08*** | (2006.01) |
| ***B63H 9/10*** | (2006.01) |

(52) U.S. Cl.

CPC ..... *B63H 9/061* (2020.02); *B63H 9/08* (2013.01); *B63H 9/1021* (2013.01);
(Continued)

(58) Field of Classification Search

CPC ..... B63H 9/0607; B63H 9/08
See application file for complete search history.

(56) References Cited

U.S. PATENT DOCUMENTS 4,388,888 A * 6/1983 Gushurst, Jr. ..... B63H 9/1092 114/90
4,685,410 A * 8/1987 Fuller ..... B63H 9/1021 114/39.31

(Continued)

FOREIGN PATENT DOCUMENTS

CN 104890845 A 9/2015
CN 102700697 B 10/2015

(Continued)

OTHER PUBLICATIONS

International Search Report in related PCT/EP2017/079764 dated Jan. 3, 2018.

*Primary Examiner* — S. Joseph Morano
*Assistant Examiner* — Jovon E Hayes
(74) *Attorney, Agent, or Firm* — Harness, Dickey & Pierce, P.L.C.

(57) ABSTRACT

A sail includes at least three sides, namely two longitudinal sides respectively called "luff" and "leach", as well as a lower transverse side called "foot" consisting of an assembly of panels having transverse edges parallel to the foot and longitudinal edges parallel to the luff and the leach, each panel being hinged to the adjoining panel around an axis parallel to the foot. Each of the panels includes reinforcing elements distributed into the two following groups: (a) a first group in which they extend parallel and in proximity to said transverse edges, and (b) a second group in which they extend parallel and in proximity to the longitudinal edges of the panel. They are connected two by two by connection parts in the continuation of the reinforcing elements of the second group, so that the forces assumed by the reinforcing (Continued)

elements are transmitted longitudinally from one panel to another.

20 Claims, 8 Drawing Sheets

(52) U.S. Cl.
CPC ..... *B63H 9/1092* (2013.01); *B63H 9/0628* (2020.02); *B63H 9/0635* (2020.02); *B63H 2009/086* (2013.01)

(56) References Cited

U.S. PATENT DOCUMENTS

| | | | | | |
|---|---|---|---|---|---|
| 5,038,699 | A * | 8/1991 | Cochran | B63H 8/00 | 114/97 |
| 5,775,249 | A * | 7/1998 | Samuel | B63H 9/0615 | 114/102.23 |
| 6,382,120 | B1 * | 5/2002 | Keire | B63H 9/067 | 114/102.29 |
| 8,281,727 | B2 * | 10/2012 | Gonen | B63B 15/0083 | 114/102.29 |
| 8,776,708 | B2 * | 7/2014 | Cordier | B63H 9/0628 | 114/102.12 |
| 2019/0270498 | A1 * | 9/2019 | Vautier | B63H 9/08 | |

FOREIGN PATENT DOCUMENTS

| | | | |
|---|---|---|---|
| JP | S56116593 | A | 9/1981 |
| WO | WO-2010/094770 | A1 | 8/2010 |

* cited by examiner

SHIP'S SAIL MADE UP OF ARTICULATED PANELS AND SHIP EQUIPPED THEREWITH

CROSS-REFERENCE TO RELATED APPLICATIONS

This application is a National Phase Entry of International Patent Application No. PCT/EP2017/079764, filed on Nov. 20, 2017, which claims priority to French Patent Application Serial No. 16614489, filed on Nov. 25, 2016, both of which are incorporated by reference herein.

TECHNICAL FIELD

The present invention relates to a sail, particularly one of large dimensions, as well as to a vessel equipped with it.

BACKGROUND

More precisely, the present invention has as its object the implementation of a sail suitable for the operation of a commercial or passenger transport vessel, i.e. a sail capable of being used intensively (even on vessels the righting moment whereof is very high), regardless of the meteorological conditions encountered, while maximizing the return on investment of the rig and the sail. One of the difficulties with existing sails, when they are used in large vessels, relates to the high forces developed by these sails, which can exceed 100 tonnes in the most heavily loaded zones such as the clews. These values are considerably greater than those which sails manufactured based on currently available technologies are able to resist (on the order of 50 tonnes).

At present, the sails available on the market are, to the knowledge of the present applicant, thin membranes of three types. The first consists of sails made of fabrics in sewn and/or glued widths. This method is very costly and reaches a natural limit for the manufacture of sails of large dimensions due to the inherent weight of the fabrics to be handled and the capacity of the machines for sewing and piercing considerable thicknesses of very strong fabric.

Also known are sails made of fabric panels, panels assembled together mechanically using circular carbon battens (method developed by the Doyle Sails company) and by a cable which runs along the leach of the sail (the free side of the triangle formed by the edges of the sail, i.e. the side which is not intended to be attached to the mast or to the boom). Finally, sails made by molding are known, formed by assembling high-strength fibers using a flexible resin or film, using a mold (3Di and 3DL methods of the North Sails company, for example). This method is very costly and essentially intended for competition and for the "super yacht" field, i.e. for luxury yachts. Methods intermediate to the aforementioned exist, particularly when the dimension of the sails is greater than that of the molds and the sails are implemented based on two or three molded subassemblies assembled together by sewing and/or gluing. One technique of this type is employed for example by the Incidence Sails sail loft.

These existing sails have, however, the disadvantages mentioned above in their lack of resistance to large forces when their surface increases substantially, so that there does not exist, to the knowledge of the present applicant, sails of large dimensions capable of resisting forces on the order of 100 tonnes. Even the device described in document WO 2010/094770, in the name of the present applicant, does not completely solve this set of problems. The present invention has the aim of filling this gap and proposing a sail which is resistant to large forces and the use whereof remains substantially identical to current sails.

SUMMARY

Thus, the present invention relates to a sail of a vessel which includes at least three sides, namely two longitudinal sides respectively called "luff" and "leach", as well as a lower transverse side called "foot", the sail consisting of an assembly of panels, these panels having transverse edges substantially parallel to said foot and longitudinal edges which are substantially parallel respectively to said luff and said leach, each panel of this assembly being hinged to the adjoining panel around an axis parallel or substantially parallel to said foot, characterized by the fact that each of the panels of said assembly includes a plurality of reinforcing elements, these elements each having the shape of an elongated strip, that these reinforcing elements are distributed at least into the following two groups:

- a first group in which the reinforcing elements extend parallel and in proximity to said transverse edges of said panel;
- a second group in which the reinforcing elements extend parallel and in proximity to the longitudinal edges of said panel;

and that said panels are connected two by two by connection parts which are situated in the continuation of the reinforcing elements of said second group, so that the forces assumed by the reinforcing elements are transmitted longitudinally from one panel to another, without discontinuity, via said connection parts.

According to other non-limiting and advantageous features of this sail, considered alone or in any combination of certain of them:

- said panels consist of a rigid material such as metal and each panel forms with the reinforcing elements that it includes a single-piece assembly;
- said reinforcing elements are applied to each panel, particularly by sewing, gluing;
- said reinforcing elements are implemented in a material selected in the following group: fabric, composite material, high-strength fibers, resin, metal and associations of at least two of these materials;
- said connection parts also constitute hinge parts of a panel with respect to the adjoining panel;
- said hinge parts comprise a link rod at the opposite ends whereof are hinged two adjoining panels, via pivots oriented perpendicularly to said reinforcing elements of said second group;
- each panel includes, along its longitudinal edge closest to the luff and at least over a portion of the length of this longitudinal edge, a guide rail in which is arranged a sliding dolly, called the "panel dolly," the movement of this panel dolly being limited by the ends of said rail;
- said reinforcing elements are present on only one of the two opposite faces of each panel;
- said reinforcing elements are present on both opposite faces of each panel and face each other two by two;

Another aspect of the invention relates to a vessel which is equipped with a sail according to one or the other of the foregoing features.

According to other features of this vessel:

- each panel of the sail is connected to the mast by means of an assembly comprising a sliding dolly called the "mast dolly," which is configured to slide along said mast, as well as a connection device which is connected, on the one hand, to said "mast dolly" and on the other hand to said panel, said connection device allowing the displacement of the panel with respect to said "mast dolly" in the direction of the luff;

said connection device comprises a flexible connection means attached to said panel;

said connection device comprises a panel dolly configured to slide in a guide rail positioned along the longitudinal edge closest to the luff of the panel, and a connection and hinge part (80) connecting the panel dolly to the mast dolly;

at least one portion of the panels of the sail includes, along its longitudinal edge closest to the luff and at least over a portion of the length of this longitudinal edge, a guide rail in which is arranged a sliding dolly, called the panel dolly, the displacement of this panel dolly being limited by the ends of said rail, and said panel dolly and mast dolly are hinged with respect to one another by means of a connection and hinge part, the assembly, consisting of the panel dolly and the connection and hinge part constituting said connection device, so that they are movable between a first position in which they extend substantially in the same plane when the sail is raised, and a second position in which they extend along substantially perpendicular planes when said sail is furled.

Advantageously, this vessel in which each panel of the sail includes, along its longitudinal edge closest to the luff and at least over a portion of the length of this longitudinal edge, a guide rail in which is arranged a sliding dolly, called a panel dolly, the displacement of this panel dolly being limited by the ends of said rail, is characterized by the fact that said mast is provided with a sliding dolly called a "mast dolly," which is formed to slide along said mast, and said panel dolly and mast dolly are hinged with respect to one another by means of a connection and hinge part so that they are movable between a first position in which they extend substantially in the same plane when the sail is raised, and a second position in which they extend along substantially perpendicular planes when said sail is furled.

The membrane of a sail, i.e. its constituent material, regardless of its embodiment, has a surface which satisfies two distinct functions, namely:

1/ a surface subjected to aerodynamic pressures and which develops local forces, which translates into an aerodynamic function;

2/ a surface which assumes the aerodynamic forces and transmits them to the rig, which translates into a structural function.

The main reason for which the conventional manufacturing methods find their technical and financial limits, resides in the structural function of the sail, which must assume and transmit aerodynamic forces to the rig, namely the mast and the boom. The fundamental idea of the present invention is to separate, i.e. to decouple these two functions with a sail consisting of panels interconnected by a very limited number of mechanical connections intended to cause forces to transition, i.e. to pass between panels.

Each panel is thus constituted of a reinforced membrane. The membrane can be made in particular of fabric, of composite material or of metal.

The reinforcements of the membrane extend essentially at the periphery of the panel and can be made for example of high-strength fibers, of composite material or of metal. The number and the position of these reinforcements inside a panel can be adapted to the dimensions of the sail. The forces assumed by these reinforcements of the membrane can be transmitted from one panel to another by means of connection parts connecting the respective reinforcements parallel or substantially parallel to the luff and/or the leach edge of two adjoining panels.

The folding of this sail can be made possible by hinging the panels with respect to one another by means of the connection parts. Intermediate connections between two adjoining panels can be added so as to synchronize the relative movement of these two panels and avoid contrary displacements with respect to one another during folding. However, these intermediate connections do not assume forces. Each panel can be provided along its luff with a guide rail formed to receive a sliding "double dolly" thus connecting said panel to a guide rail carried on the mast. Said dolly can thus displace itself along the guide rail of the panel and the guide rail of the mast.

BRIEF DESCRIPTION OF THE DRAWINGS

Other features and advantages of the invention will appear upon reading the detailed description that follows. It will be made with reference to the appended drawings in which.

DETAILED DESCRIPTION

Figure 1:
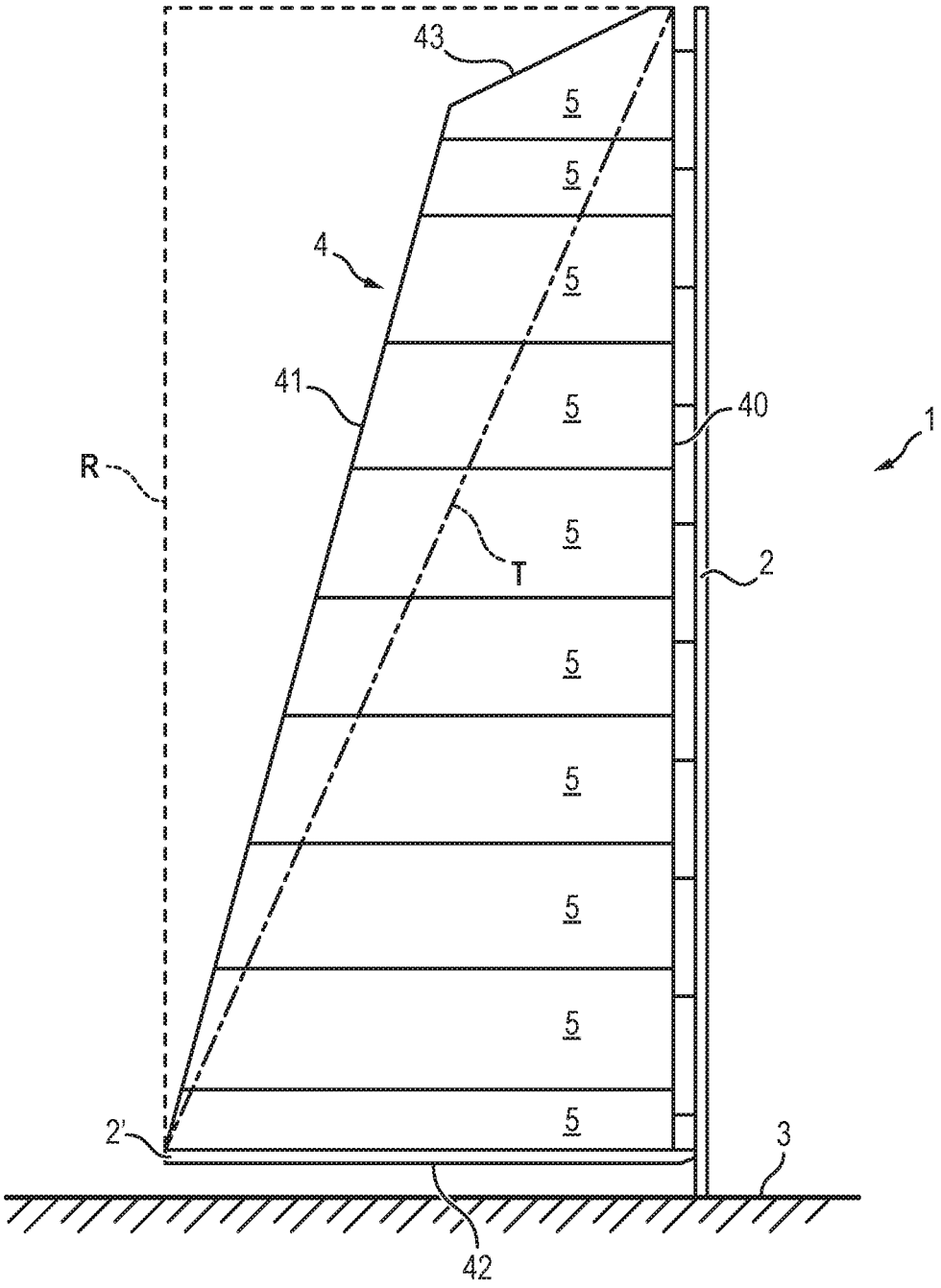
FIG. 1 is a very schematic front view of a sail of a vessel formed with hinged panels, in conformity with an embodiment of the invention.

The sail which is shown in FIG. 1 is shown in the raised position, in place on a mast 2 provided with a boom which equips the deck of a vessel 1. This vessel will no longer be shown in detail because it does not really constitute the core of the invention. At all events, it can be a liner, a freight transporting vessel, a fishing vessel, a cruising sailboat, a yacht, etc.

In the embodiment illustrated in FIG. 1, the sail has the shape of a quadrilateral which is inscribed inside a right triangle. More precisely, this sail includes two longitudinal sides 40 and 41 which are respectively denominated, in the terms of the trade, "luff" and "leach," a lower transverse side called a "foot" 42 attached to the boom, as well as an upper transverse side 43. In an embodiment not described here, the sail could be inscribed within a rectangle like that defined by the dotted lines R, or in a right triangle such as that delimited by the mixed lines T, these lines being visible in the aforementioned figure.

Figure 2:
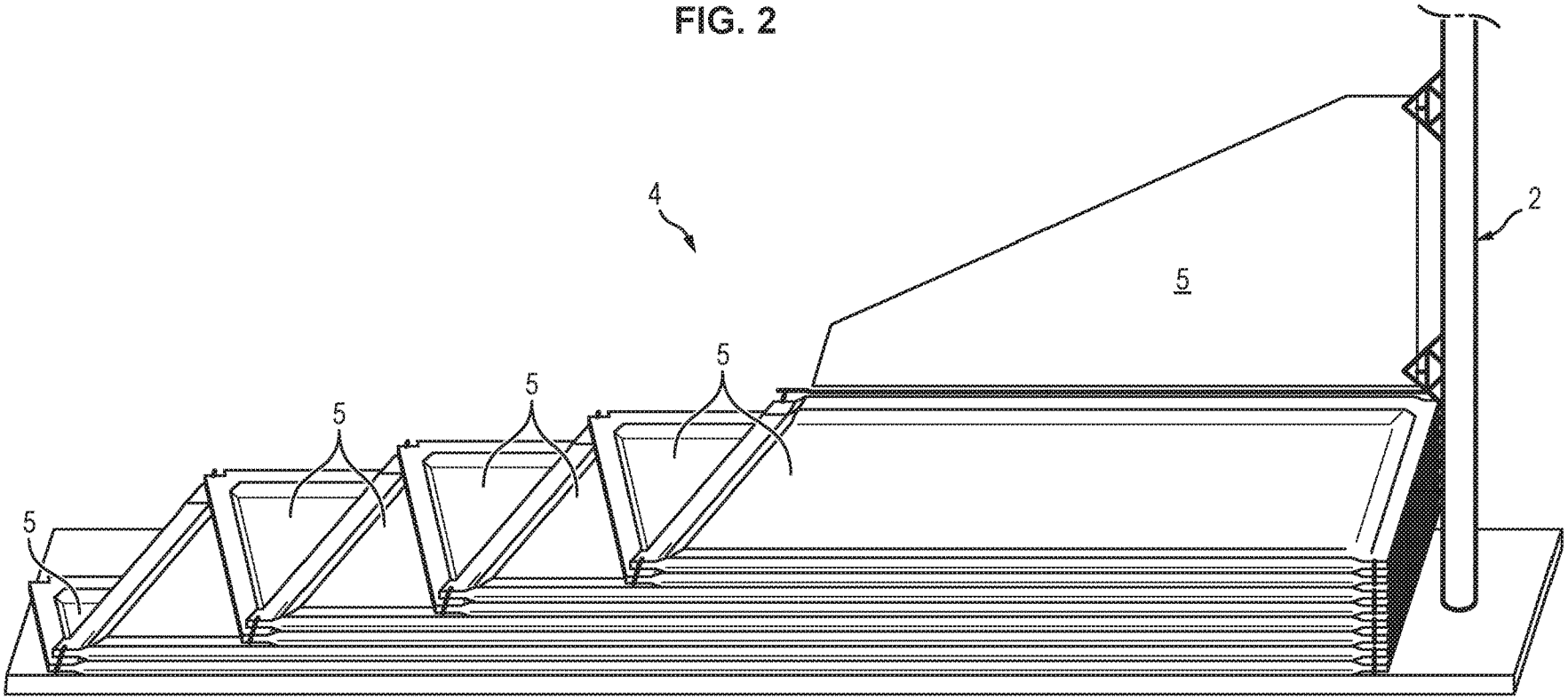
FIG. 2 is a perspective view, also very schematic, of the sail of FIG. 1 shown in the almost completely folded position.

In conformity with the invention, this sail consists of an assembly of panels 5. In FIG. 1, ten panels 5 are shown but this number may be different, i.e. lesser or greater. The sail 4 of FIG. 1 is shown in FIG. 2 in the furled position so that the different panels 5 constituting it are superimposed alternately on one another at a lower position on the mast, in a "zigzag" or "accordion" arrangement.

Figure 3:
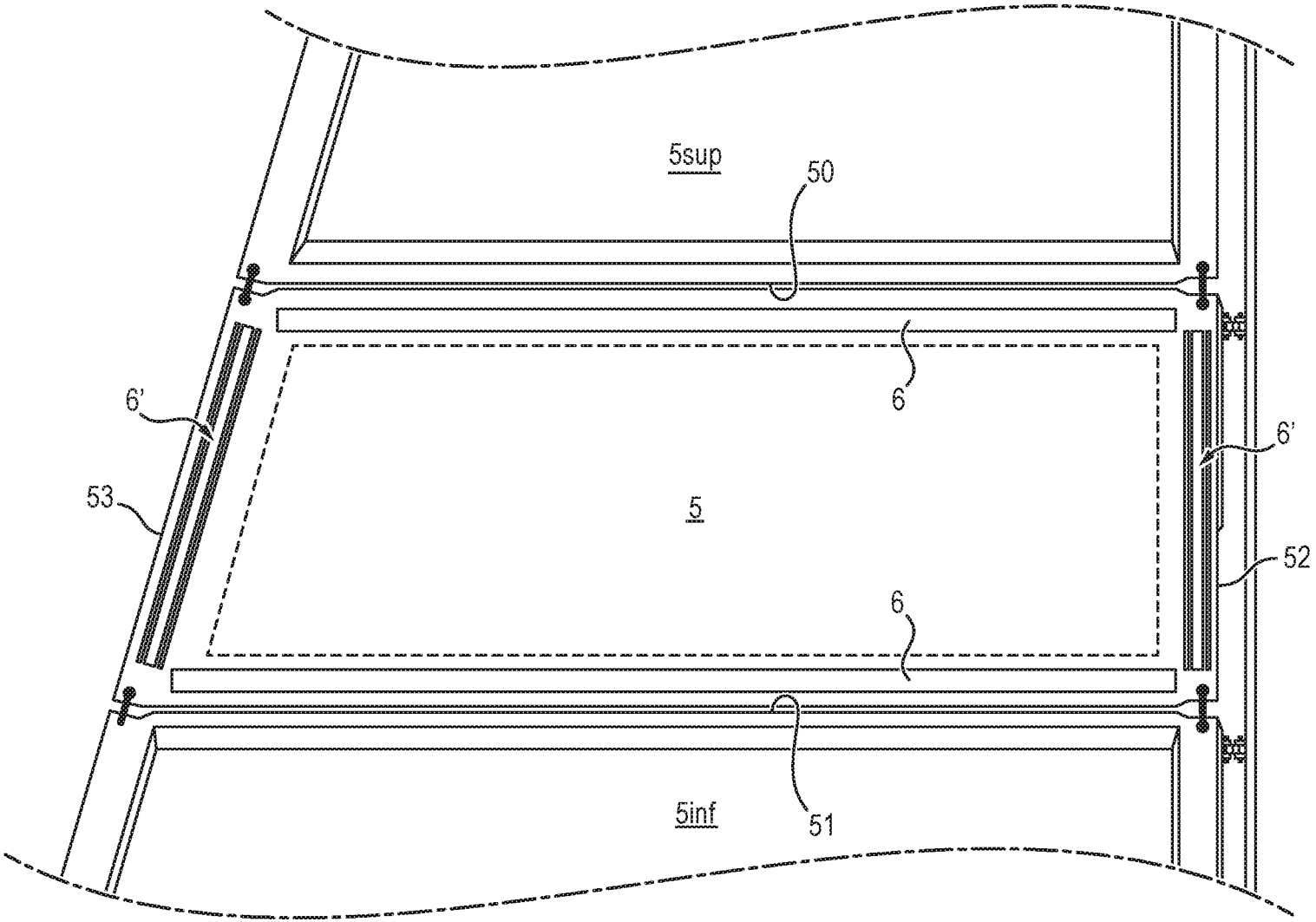
FIG. 3 is a partial front view of three adjoining panels, constituting the sail of FIG. 1, this figure being more particularly intended to illustrate the reinforcing elements which they include.

Referring more specifically to FIG. 3, the structure of the aforementioned panels 5 is described hereafter. This description is made for a particular panel 5 and its immediately adjoining panels 5*sup* and 5*inf*. However, this description also applies to the assembly of the panels 5 of the sail 4. These panels have upper 50 and lower 51 transverse edges, as well as longitudinal luff edge 52 and leach edge 53, these last two edges being called "luff edge" and "leach edge" because they are next to the luff, respectively the leach of the sail 4.

Each panel is formed from material such as fabric, a composite material, a metal, or associations of at least two of these materials. A material which is particularly suited is that known under the trademark MYLAR and which consists of polyethylene terephthalate.

These panels 5 include a plurality of reinforcing elements 6 and 6', each element 6 and 6' having the shape of an elongated strip. The reinforcing elements 6 and 6' are preferably present on each of the two opposite faces of the panel 5 but they could be considered be on only one face.

These reinforcing elements are distributed into two groups. The first group consists of reinforcing elements 6 which extend parallel and in proximity to the upper 50 and lower 51 transverse edges of the panel. These reinforcing elements are shown schematically in FIG. 3, but it is necessary to consider that these elements extend until the immediate proximity of the longitudinal edges 52 and 53 of the panel 5. The second group of reinforcing elements consists of the elements 6' which extend parallel and in proximity to the longitudinal edges 52 and 53 of the panel 5. Just as for the reinforcing elements of the first group, the reinforcing elements 6' of the second group extend preferably to the immediate vicinity of the transverse edges 50 and 51 of the panel 5.

When the panel consists of a rigid material such as metal, these reinforcing elements can be integrated into the panel itself so as to constitute a single-piece assembly. This is then a panel which, to some degree and by way of a simple comparison, resembles a door panel which would be equipped with a peripheral molding. This signifies that the panel 5 has additional peripheral thicknesses which are embodied in the reinforcing elements 6 and 6'. This type of panel preferably equips vessels subjected to strong loads, such as commercial vessels, liners and fishing boats.

In all other specific cases, where the reinforcing elements 6 and 6' do not form a single-piece assembly with the panel 5, these reinforcing elements 6 and 6' are then applied to each panel 5, particularly by sewing, gluing, welding mechanical assembly, etc. In the same manner as for the material which constitutes the panel itself, the reinforcing elements can consist of fabric, of composite material, of metal or of associations of at least two of these materials, a list to which can also be added high-strength fibers such as those formed by carbon or aramid. The value of the presence of the reinforcing elements 6 which extend parallel to the lateral edges 50 and 51 of the panel 5 is that the transverse forces to which the sail is subjected during navigation are transmitted essentially to the mast 2 of the vessel 1.

As for the reinforcing elements 6' of the second group, they withstand the longitudinal forces which are retransmitted from top to bottom along the sail 4, as well be seen later. This assumption of forces by the reinforcing elements 6' is made from one panel to the adjoining panel by connection parts which are labeled with reference symbol 7 in FIGS. 4 and 5. In this particular embodiment, the parts 7 also have the function of allowing relative hinging of the panels 5.

More precisely, these connection parts are situated in the continuation of the reinforcing elements 6' of the second group. Thus, when referring to FIG. 4, the transmission axis of the leach forces has been labeled Y-Y'. This axis corresponds to the longitudinal axis of the reinforcing elements 6' which equip the panel 5 and the panel 5*inf* situated immediately below. The reinforcing element 6' have not been embodied in FIGS. 4 and 5 for the simple purpose of simplification.

Figure 4:
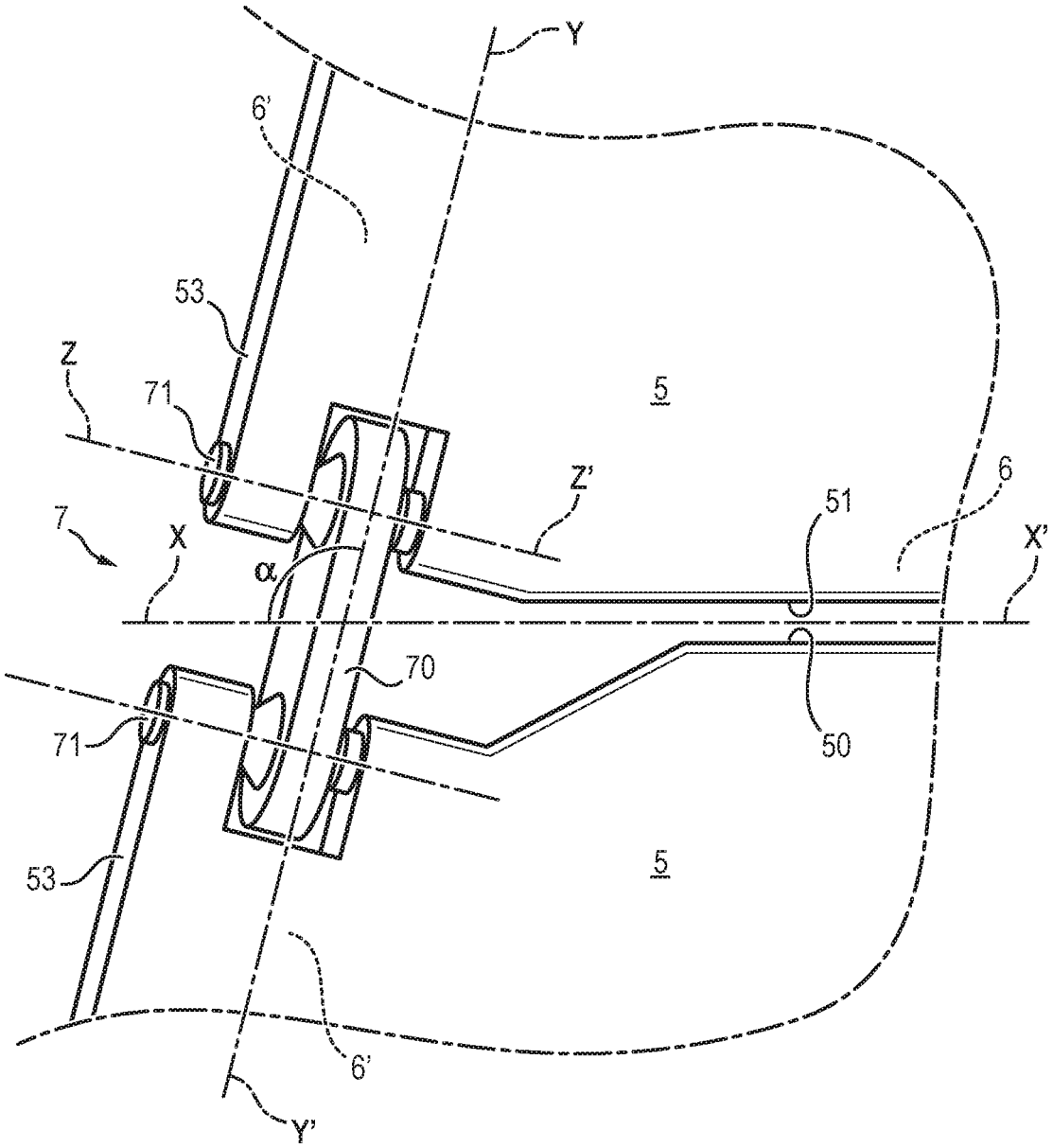
FIG. 4 is a partial front view of two adjoining panels showing specifically one of the connection parts which connects them, this part being situated on the side of the leach of the sail.

The connection part 7 which is visible in FIG. 4 includes a link rod 70 which is situated on the aforementioned axis Y-Y'. This axis forms with the transverse axis X-X' (parallel to the transverse edges of the panels) where two panels are hinged, an angle $\alpha$ slightly greater than 90°. The value of this angle is equal to that which the foot 42 forms with the leach 41 of the sail 4.

The link rod 70 is hinged around two pivots 71 which are integrated into each of the panels 5, pivots which extend along an axis Z-Z' perpendicular to the axis of transmission Y-Y'. To facilitate the movement of the hinge of the two panels 5 with respect to each other, notches are provided in these panels to accommodate the link rod 70 and its pivots 71, as shown in FIG. 4.

In an entirely similar manner, the reinforcing elements 6' which are disposed on the longitudinal side of the luff 52 are separated from each other by an identical connection part 7. However, in this particular case, the angle $\beta$ which the axis of transmission of the leach forces Y1-Y1' forms is perpendicular to the hinge axis X-X' of the panels 5. There too, notches are provided at this point to facilitate the hinging motion.

Figure 6:
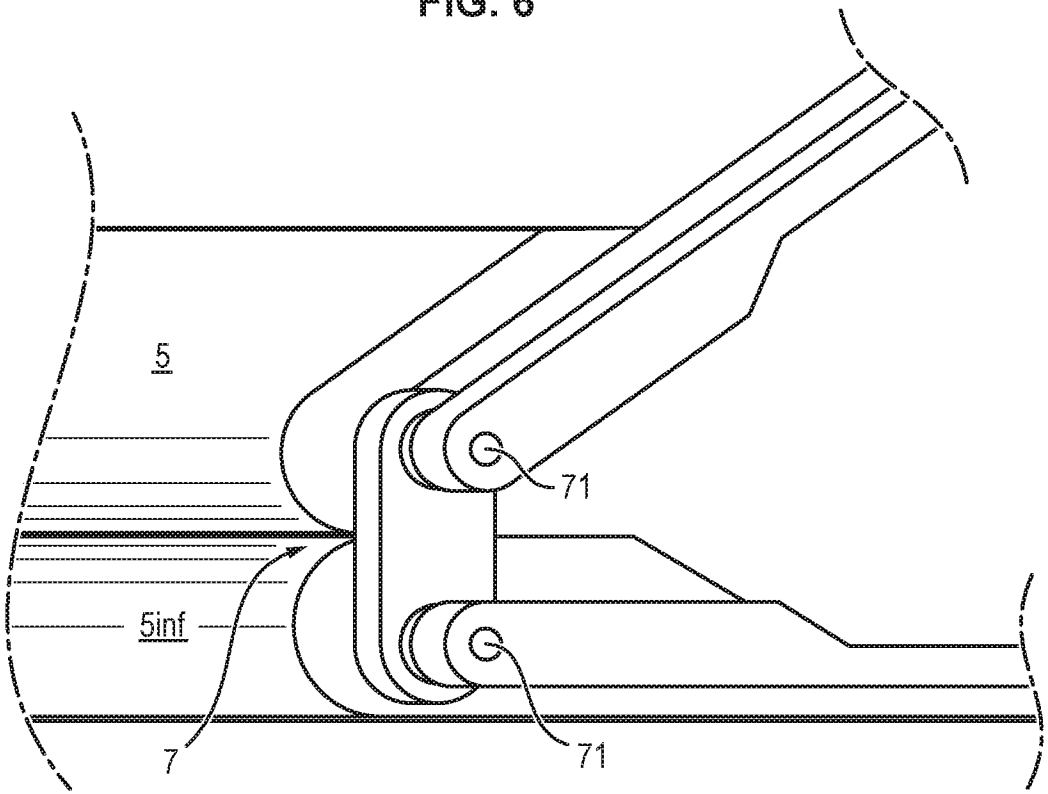
FIG. 6 is a partial perspective view of two panels like those shown in the foregoing figures, these panels being partially folded over one another, this figure being more particularly to show the positioning of one of the connection parts.

Of course, although there exists a free space between the panels 5 to allow folding of the sail 4, a person skilled in the art will know how to reduce this space to a minimum to affect as little as possible the aerodynamics of the assembly. Observing FIG. 6, it is understood that the link rod 7 is dimensioned in such a manner that even when the panels 5 and 5*inf* are folded one upon the other, it does not generate any protruding additional thickness which would be contrary to proper stacking of the other panels to be folded. Adding other reinforcing elements not visible in the appended figures to the aforementioned elements 6 and 6' cannot be excluded. Assuming this, these additional elements are preferably disposed substantially vertically inside the panel, and have as their main function to assume forces generated by the sail if the reinforcing elements 6 and 6' mentioned above are not sufficient alone to assume the longitudinal forces generated in the sail or if the two connection parts described above, situated vertically above the aforementioned sole reinforcing elements 6 and 6', are not sufficient to ensure the integrity of the sail.

To facilitate folding of the sail 4, it is advantageous to synchronize the relative movement of two adjoining panels 5 so that the link rods 70 constantly remain normal to the bisector of the angle formed by the two planes of the concerned panels 5. To this end, it is possible to consider installing between the two adjoining panels a tilt-proof link rod assembly or gear assembly which will allow tilting of two panels with respect to one another in one direction, and prevent it in the opposite direction.

Figure 7:
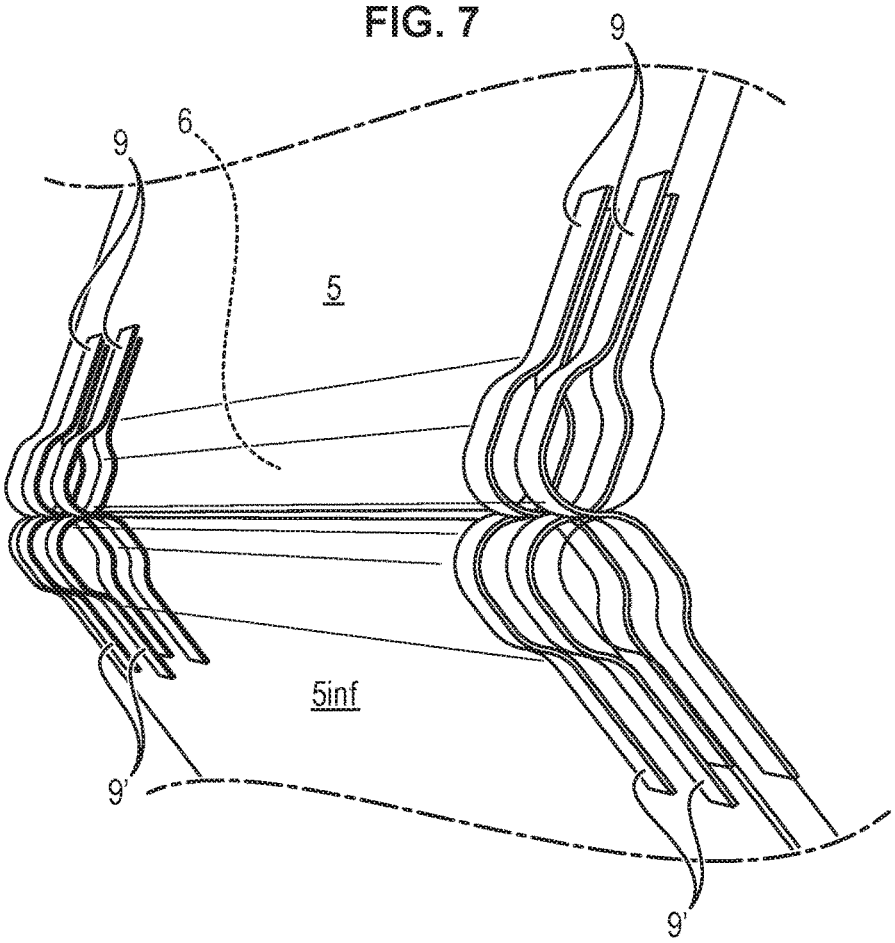
FIG. 7 is a partial perspective view of two panels of the sail, these panels being provided with so-called "synchronization" straps.
Figure 8A:
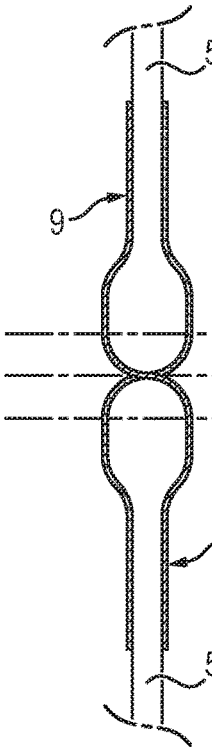
FIGS. 8A to 8D are schematics illustrating different positioning of the panels of FIG. 7 and of the straps that are associated with it.
Figure 8B:
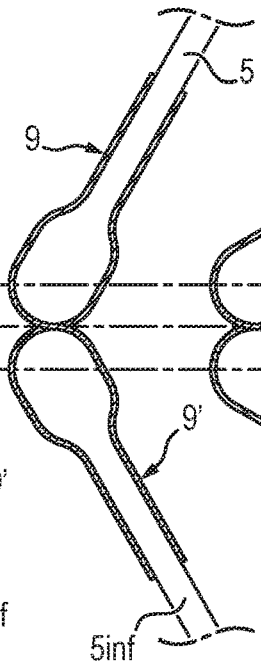
Figure 8C:
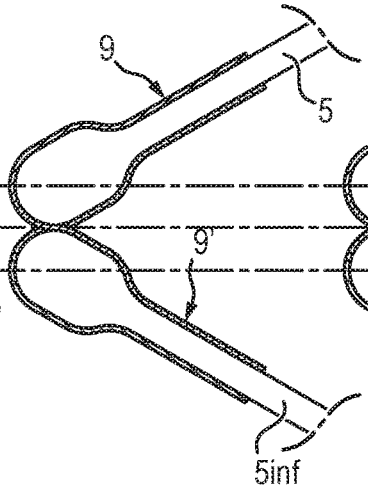
Figure 8D:
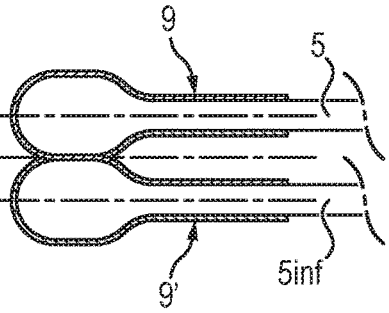

Another simple and practical solution to implement is shown in FIG. 7 as well as in FIGS. 8A to 8D. It uses "crossed" straps. In this particular case, and as shown more specifically in FIG. 7, these are pairs of straps 9 and 9' which are disposed on the transverse edges of the panels 5 and parallel to the longitudinal edges of these same panels. In the case shown here, these are panels 5 made of metal including single-piece reinforcing elements 6 which generate a very visible additional thickness.

These pairs of straps 9 and 9', numbering two in the example illustrated, are arranged in such a manner that they begin for the pair 9 on the front face of a panel 5 and extend to the opposite face of the immediately lower panel 5*inf*. In this manner, they pass around the lower transverse edge 51 of the panel 5 as well as the upper edge 50 of the panel 5*inf*. In a similar manner and on the second face of the panel 5, straps 9' begin and extend to the front face of the lower panel 5*inf*. These are non-extendable straps, so that the developed length of their path is invariable, which ensures folding without slipping of the straps 9 and 9' on the panels 5, the center distance between panel is conserved, as shown more particularly by FIGS. 8A to 8D.

To allow the sail to be raised or to bring it back into the furled position, each panel 5 is provided along its longitudinal edge 52 closest to the luff 40, with a guide rail 520 in which is arranged a sliding dolly 8' called a "panel dolly," this dolly 8' being formed to move freely along the rail while still having its displacement limited by the opposite ends of this rail 520. This rail extends for example only over a portion of the edge 52. Moreover, and in known fashion, the mast 2 to which is associated the sail 4 is also provided with a dolly 8 called the "mast dolly," which is formed to slide in a longitudinal groove formed in the mast.

Figure 5:
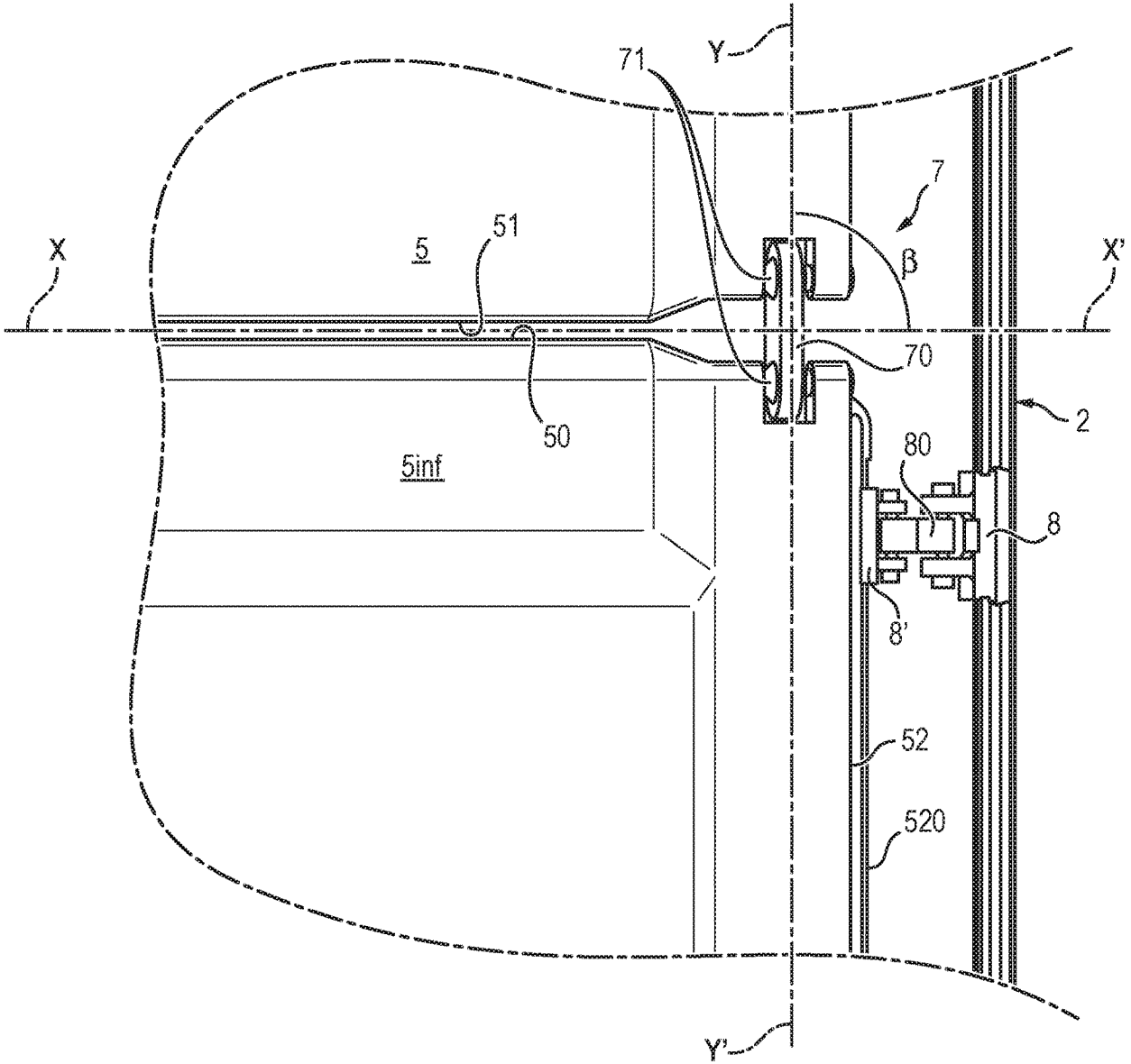
FIG. 5 is also a partial front view of the two adjoining panels of FIG. 4, showing specifically one of the connection parts which connects them, this part being situated on the side of the luff of the sail, specifying that there is also visible in this figure a pair of dollies for guiding the panels of the sail relative to the mast of the vessel which is equipped with them.

A hinge part forming a ball joint 80 is visible between these two dollies in FIG. 5, which is formed so as to allow the dolly 8' to occupy either a position parallel to the dolly 8, as shown in FIG. 5, or a position perpendicular to that of the dolly 8, so that this "double dolly 8-8'" allows longitudinal sliding of the panels 5 along the mast 2 without however impeding the maneuvers of deployment and folding of the sail. Of course, in an optimized configuration of the invention, all the panels of the sail will not be provided with a guide rail 520 along their longitudinal edge 52 closest to their luff 40. A person skilled in the art will be able to determine the number of mast dollies needed to affect as little as possible the aerodynamic properties of the assembly and/or the kinematics of folding/unfolding the sail.

Figure 9:
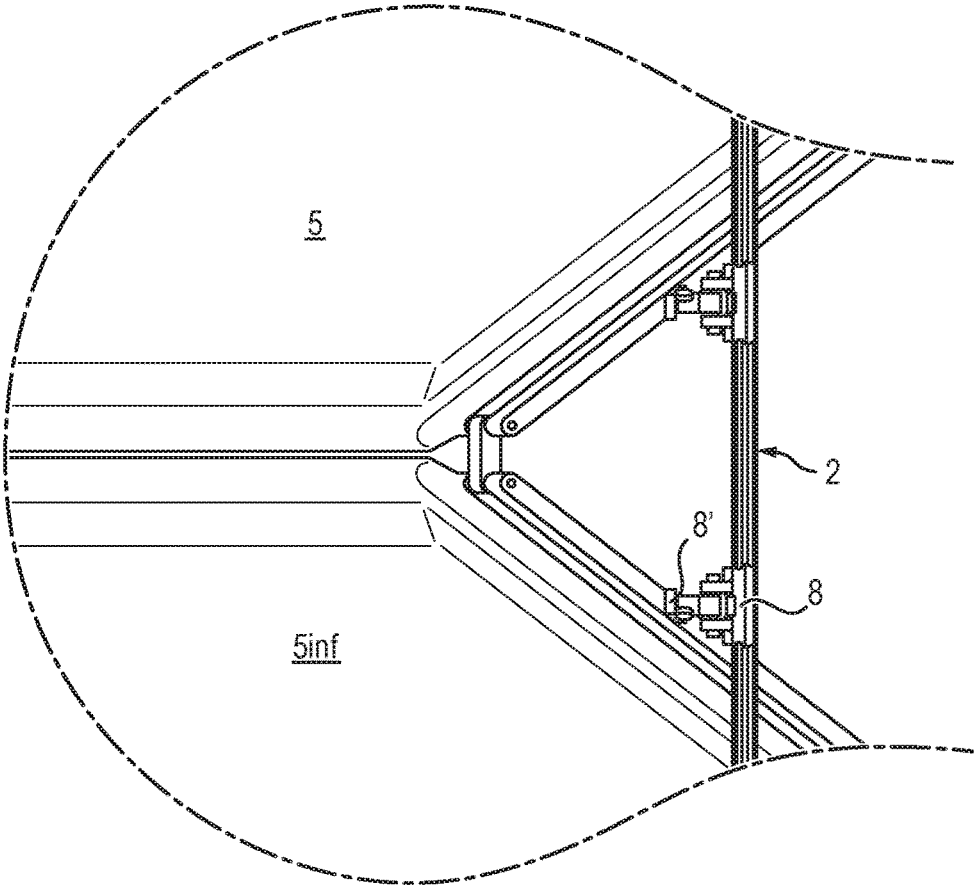
FIG. 9 is a partial perspective view of two panels which occupy a partially folded position.
Figure 10:
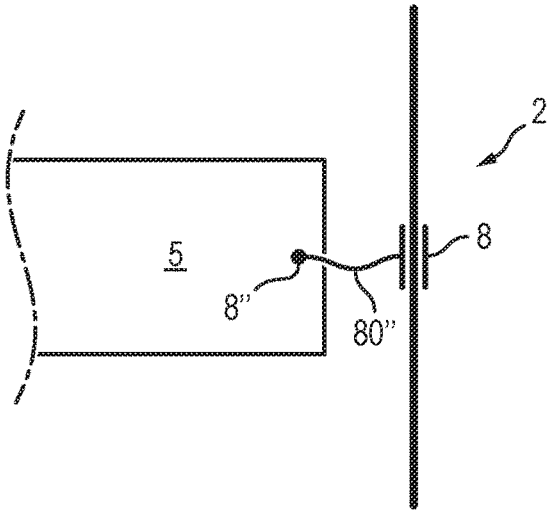
FIG. 10 is a schematic showing a variant of the means which connect the panels of the sail to the mast of the vessel.

Two panels 5 and 5*inf* are visible in FIG. 9 in an intermediate folding position in which said dollies 8 and 8' form an acute angle between them. In the variant embodiment of FIG. 10, and as in the previous embodiments, the mast 2 is equipped with a dolly 8. On the other hand, the connection to each panel 5 is accomplished by a connection device 80" which consists for example of a textile or polymer material cord. It is solidly attached to the aforementioned dolly 8, as well as to the panel 5, in at least one point 8".

The invention claimed is:

1. A sail of a vessel, said sail comprising:

a luff side, a leach side, and a foot side, said sail comprising an assembly of panels having transverse edges substantially parallel to said foot side and longitudinal edges which are substantially parallel respectively to said luff side and said leach side, each of said assembly of panels being hinged to an adjoining said panel around an axis parallel or substantially parallel to said foot side;

each of said assembly of panels including a plurality of reinforcing elements each having the shape of an elongated strip;

said reinforcing elements being distributed at least into the following two groups:

(a) a first group in which said reinforcing elements extend parallel and in proximity to said transverse edges of said assembly of panels; and (b) a second group in which said reinforcing elements extend parallel and in proximity to the longitudinal edges of said assembly of panels;

said assembly of panels being connected two by two by connection parts which are situated in continuation of said reinforcing elements of said second group, so that forces assumed by said reinforcing elements are transmitted longitudinally from one of said panels to another, without discontinuity, via said connection parts.

2. The sail according to claim 1, wherein said panels include a rigid material and each of said panels forms with said reinforcing elements that it includes a single-piece assembly.

3. The sail according to claim 1, wherein said reinforcing elements are applied to each panel, by sewing or gluing.

4. The sail according to claim 3 wherein said reinforcing elements are a material selected from the following group: fabric, composite material, high-strength fibers, resin, metal or associations of at least two of these materials.

5. The sail according to claim 1, wherein said connection parts also constitute hinge parts of one of said panels with respect to an adjoining panel.

6. A sail of a vessel, said sail comprising:

a luff side, a leach side, and a foot side, said sail comprising an assembly of panels having transverse edges substantially parallel to said foot side and longitudinal edges which are substantially parallel respectively to said luff side and said leach side, each of said assembly of panels being hinged to an adjoining said panel around an axis parallel or substantially parallel to said foot side;

each of said assembly of panels including a plurality of reinforcing elements each having the shape of an elongated strip;

said reinforcing elements being distributed at least into the following two groups:

(a) a first group in which said reinforcing elements extend parallel and in proximity to said transverse edges of said assembly of panels;

(b) a second group in which said reinforcing elements extend parallel and in proximity to the longitudinal edges of said assembly of panels;

said assembly of panels being connected two by two by connection parts which are situated in continuation of said reinforcing elements of said second group, so that forces assumed by said reinforcing elements are transmitted longitudinally from one of said panels to another, without discontinuity, via said connection parts; and wherein said connection parts also constitute hinge parts of one of said panels with respect to an adjoining panel and wherein said hinge parts comprise a link rod at opposite ends which are hinged to two adjoining of said panels via pivots oriented perpendicularly to said reinforcing elements of said second group.

7. The sail according to claim 6, wherein each of said panels includes, along its longitudinal edge closest to said luff side and at least over a portion of a length of said longitudinal edge, a guide rail in which is arranged a sliding panel dolly, displacement of said panel dolly being limited by ends of said guide rail.

8. The sail according to claim 6, wherein said reinforcing elements are present on only one of two opposite faces of each of said panels.

9. The sail according to claim 6, wherein said reinforcing elements are present on both opposite faces of each of said panels and face each other two by two.

10. A vessel comprising a mast which is equipped with a sail, said sail comprising:

a first longitudinal side, a second longitudinal side, and a lower transverse side, said sail comprising an assembly of panels having transverse edges substantially parallel to said lower transverse side and longitudinal edges which are substantially parallel respectively to said first longitudinal side and second longitudinal side, each of said assembly of panels being hinged to an adjoining said panel around an axis parallel or substantially parallel to said lower transverse side, each of said assembly of panels including a plurality of reinforcing elements, said reinforcing elements being distributed at least into the following two groups:

(a) a first group in which said reinforcing elements extend parallel and in proximity to said transverse edges of said assembly of panels; and (b) a second group in which said reinforcing elements extend parallel and in proximity to the longitudinal edges of said assembly of panels;

said assembly of panels being connected by connection parts situated in continuation of said reinforcing elements of said second group, so that forces assumed by said reinforcing elements are transmitted longitudinally from one of said panels to another, without discontinuity, via said connection parts.

11. The vessel according to claim 10, wherein each of said panels of said sail is connected to said mast by:

a sliding mast dolly which is configured to slide along said mast; and a connection which is connected, on one hand, to said mast dolly and on another hand to said panels, said connection allowing displacement of said panels with respect to said mast dolly in a direction of said first longitudinal side.

12. The vessel according to claim 11, wherein said connection comprises a flexible connection means attached to said panel.

13. The vessel according to claim 11, wherein said connection comprises a panel dolly configured to slide in a guide rail positioned along a longitudinal edge closest to said first longitudinal side, and a connection and hinge part connecting said panel dolly to said mast dolly.

14. The vessel according to claim 10, wherein at least one portion of said panels of said sail includes, along its longitudinal edge closest to said first longitudinal side and at least over a portion of a length of said longitudinal edge, a guide rail in which is arranged a sliding panel dolly, displacement of said panel dolly being limited by ends of said rail, and said panel dolly and mast dolly are hinged with respect to one another by a connection and hinge part, said assembly, including said panel dolly and said connection and hinge part constituting a connection device, so that they are movable between a first position in which they extend substantially in a same plane when said sail is raised, and a second position in which they extend along substantially perpendicular planes when said sail is furled.

15. A sail of a vessel, said sail comprising:

a luff side, a leach side, and a foot side, said sail comprising an assembly of panels, each panel comprising:

a transverse edge substantially parallel to said foot side;

a first longitudinal edge substantially parallel to said luff side;

a second longitudinal edge substantially parallel to said leach side;

a first reinforcing element extending parallel to and in proximity to the first longitudinal edge; and a second reinforcing element extending parallel to and in proximity to the second longitudinal edge;

each panel being hinged to an adjoining said panel around an axis parallel to said foot side by a first connection part and a second connection part, wherein said first connection part is aligned with said first reinforcing element and said second connection part is aligned with said second reinforcing element, and wherein said first connection part is configured to transmit luff forces and said second connection part is configured to transmit leach forces longitudinally from one panel to another panel in said panel assembly; and wherein said first connection part and said second connection part permit pivoting of each panel with respect to an adjoining panel.

16. The sail according to claim 15, wherein each panel further comprises:

a guide rail along said first longitudinal edge; and a slide dolly configured to move along said guide rail.

17. The sail according to claim 16, wherein each slide dolly is configured to be coupled to a corresponding mast dolly and wherein said slide dolly is configured to rotate with respect to said mast dolly.

18. The sail according to claim 15, further comprising a synchronization assembly between each panel and an adjoining panel, wherein each synchronization assembly is configured to allow tilting of each panel and an adjoining panel in a first direction and to prevent tilting of each panel and adjoining panel in a second direction.

19. The sail according to claim 15, wherein said first connection part has a first longitudinal axis and said second connection part has a second longitudinal axis, and wherein said luff forces have a transmission axis corresponding to said first longitudinal axis and said leach forces have a transmission axis corresponding to said second longitudinal axis.

20. The sail according to claim 19, wherein said second longitudinal axis is angled with respect to said first longitudinal axis.

* * * * *